United States Patent [19]

Larson et al.

[11] 4,052,203

[45] Oct. 4, 1977

[54] CRUSHABLE LOW REACTIVITY NICKEL-BASE MAGNESIUM ADDITIVE

[75] Inventors: Floyd Gotthard Larson, Jr., Ringwood, N.J.; John Joseph deBarbadillo, II, Warwick, N.Y.

[73] Assignee: The International Nickel Company, Inc., New York, N.Y.

[21] Appl. No.: 612,367

[22] Filed: Sept. 11, 1975

[51] Int. Cl.[2] ..... C22C 33/08

[52] U.S. Cl. ..... 75/130 B; 75/130 A

[58] Field of Search ..... 75/130, 58

[56] References Cited

U.S. PATENT DOCUMENTS

| | | | |
|---|---|---|---|
| 2,529,346 | 11/1950 | Millis | 75/130 |
| 2,690,392 | 9/1954 | Millis | 75/130 |
| 3,030,205 | 4/1962 | Mills | 75/130 A |
| 3,314,787 | 4/1967 | Goodrich | 75/130 A |

FOREIGN PATENT DOCUMENTS

| | | | |
|---|---|---|---|
| 926,254 | 4/1955 | Germany | 75/130 |
| 2,304,066 | 8/1973 | Germany | 75/130 |
| 2,244,092 | 3/1973 | Germany | 75/130 |
| 685,730 | 1/1953 | United Kingdom | 75/130 |
| 1,408,324 | 10/1975 | United Kingdom | 75/130 |

OTHER PUBLICATIONS

Larson, et al., "Nickel-Iron Base Magnesium Treatment Alloy," A.I.M.E., 1974, pp. 147-162.

Cupp, et al., "Production of Nickel Base Alloys at Inco's Foundry Additives Plant," A.I.M.E., 1974, pp. 131-145.

*Primary Examiner*—P. D. Rosenberg

*Attorney, Agent, or Firm*—Miriam W. Leff; Ewan C. Macqueen

[57] ABSTRACT

A low reactivity nickel-iron-magnesium-silicon addition alloy is provided which is particularly amenable to controlled crushing and especially useful for continuous treatment methods for producing ductile cast iron.

9 Claims, 4 Drawing Figures

CRUSHABLE LOW REACTIVITY NICKEL-BASE MAGNESIUM ADDITIVE

BACKGROUND OF THE INVENTION

Figure 1:
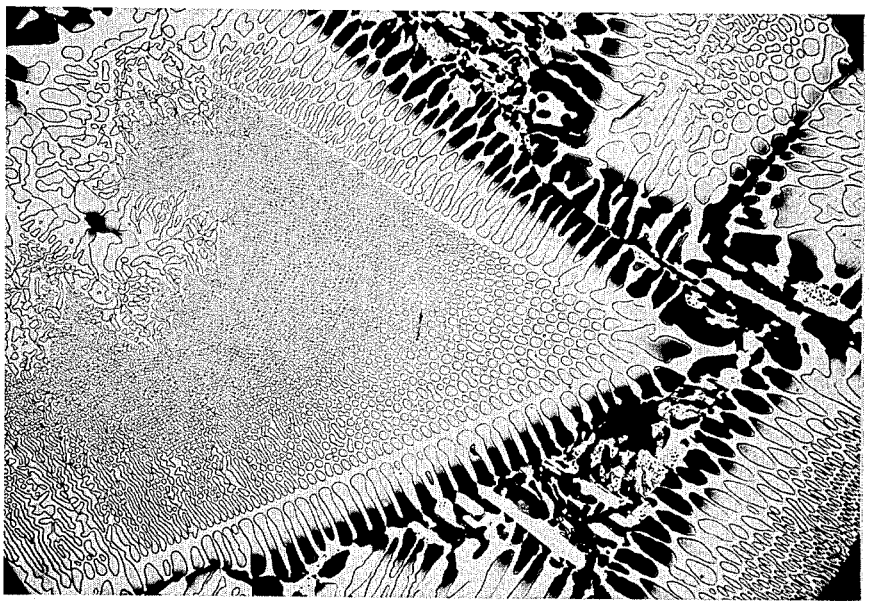

The present process relates to an improved additive for introducing magnesium into cast iron melts and to continuous treatment methods for producing ductile cast iron improved by using such additive.

It is well known to produce spheroidal graphite or ductile cast iron by the addition of magnesium as a spheroidizing agent. Since the discovery of this property of magnesium, much effort has been expended in devising safe, inexpensive ways to incorporate and retain the magnesium in cast iron. According to one of the major advances in this art, the magnesium is introduced in the form of an alloy with other metals such as iron, silicon and nickel and combinations thereof. Many nickel-based alloys containing, for example, about 5–15% magnesium have been found useful. The nickel is extremely effective in moderating the reaction between magnesium and molten iron, and it is often a beneficial constituent of the cast iron formed.

Addition alloys are used in many forms depending on the properties of the alloys and the method used to incorporate them into the molten iron. In one method the additives having a density less than that of molten iron are plunged into the melt and react as they rise; in other alloys having greater density than the melt, the additives are dropped into the melt and permitted to sink. The submerged alloys react mainly beneath the surface of the melt and the treatment can be effected in the furnace or the pouring ladle. With the recent emphasis in automation of foundry operations, interest has grown in continuous treatment techniques in making ductile cast iron, for which relatively low reactivity, relatively high density granular additives are particularly suited.

Various techniques for producing ductile cast iron which may be classified as continuous have been proposed. In general the treatment additive is introduced into a stream of molten iron as it flows through a treatment zone. The treatment zone may be a separate vessel or may be a separate area in a given apparatus. In one type of continuous molten iron flows over a bed or pocket or into an enclosed chamber containing the treatment additive and then into a ladle or mold. In another type, a dispensing device injects the treatment additive into a stream of molten iron which subsequently reacts or flows into the ladle or mold. In the "T-NOCK" process, an example of the latter type, the treatment additive is added to the center of a falling stream of molten iron. Continuous treatments are usually performed in a closed chamber, which greatly reduces the inter-action with air but greatly increases refractory erosion - hence the need for a quiet additive. It is also highly desirable for the reaction to be completed in the treatment zone. Particle size is important for achieving optimum performance. Large particles will react too slowly and will tend to clog an injection tube and pouring spout. On the other hand, very fine particles and dust will tend to react violently and to cause a problem termed "blow back" where turbulence induced by the reaction interferes with steady flow of treated iron through the exit spout and may result in rejection of the alloy from the treatment vessel. The very fine powder may also introduce excessive oxygen into the melt and hence reduce magnesium efficiency.

This is also undesirable. A useful size for the treatment alloys is roughly rice to pea size, or about ⅛ inch to about ¼ inch.

It is not new to crush additives to a size suitable for use. For example, a nickel-magnesium-carbon alloy having special utility for the purpose of introducing magnesium into molten cast iron is described in U.S. Pat. No. 2,529,346 and nickel-magnesium-silicon alloyw useful for the same purpose are described in U.S. Pat. Nos. 2,563,859 and 2,690,392. The alloys described in the aforementioned U.S. patents have been prepared by melting and casting the alloys into slabs, crushing the slabs to provide lumps of material which vary considerably in size and shape, and grading the crushed product to provide the lump size ranges desired in iron foundries. The crushing operation employed to produce the alloys in graded particulate form within the desired size range, e.g., ⅛ inch or ¼ inch or larger lumps, has always resulted in the production of a substantial quantity of fine material. These fines have been found to be of little use for the foundry production of ductile iron since the fines oxidize rapidly in contact with the molten iron with the result that they are ineffective for introducing magnesium in the molten cast iron. Accordingly, these fine materials have been segregated from the desired product and have been remelted to recover the nickel content thereof with accompanying substantial loss of the magnesium content. The presence of fines is particularly objectionable in connection with the continuous treatment processes for the reasons given previously.

A nickel-magnesium-containing alloy has now been found which has properties of crushability, density, reactivity and composition which make it particularly attractive for use in continuous treatment of molten cast iron to produce ductile cast iron. The crushability of the alloys of this invention is such that the desired size can be obtained without generating excessive amounts of fines. Moreover, particles of suitable size can be obtained with conventional crushing equipment, such as jaw crusher, disc pulverizer, roll crusher, etc. Alloys in accordance with this invention have further attributes of low reactivity when added to a cast iron melt, suitably high density, relatively low cost, and they are free of elements which might be detrimental to the production of good ductile iron.

It is an object of the present invention to provide an improved magnesium-containing addition alloy for use in a continuous treatment process for producing ductile cast iron.

It is another object to provide an alloy with controlled crushability characteristics such that particles of the desired size can be obtained without generation of excessive fines.

It is a further object that the alloys provided can be suitably crushed in conventional crushing equipment.

It is still another object that the alloys, in addition to possessing the desired crushability, have low reactivity, high density relative to the melt to which they are added, and low cost, and that they are free of elements which are detrimental to the production of good ductile cast iron.

Other objects and advantages of the invention will become apparent from the accompanying figures and the description which follows.

THE DRAWINGS

Figure 2:
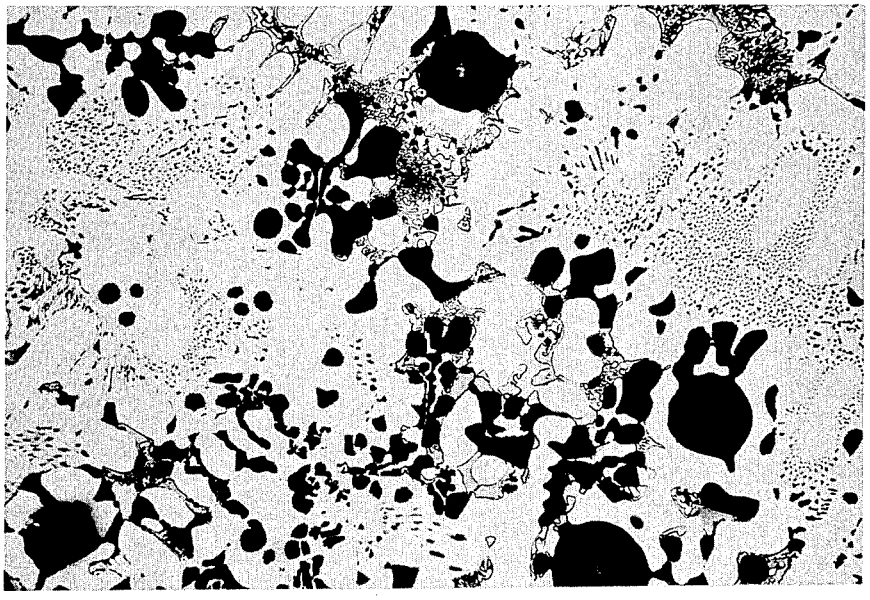
Figure 3:
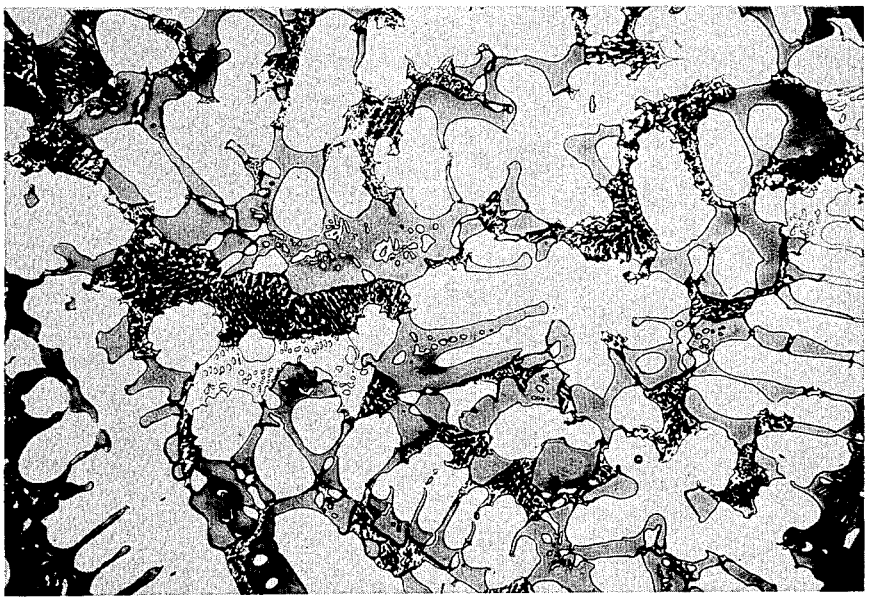

The FIGS. 1, 2, 3 and 4 are micrographs of various nickel-magnesium addition alloys shown at 500x magnification. The compositions represented in all the Figures contain roughly 60% nickel and 4 to 5% magnesium. Iron is present in all compositions in the amount of 25 to 35%. The alloys of FIGS. 1, 2 and 3 are in accordance with the present invention. The alloys shown in FIGS. 1 and 3 are essentially carbon-free. Those in FIGS. 2 and 4 contain about 1.5% carbon. The alloy of FIG. 1 is highest in silicon content, containing about 9.7%. The alloys of FIGS. 2 and 3 contain about 5% silicon, and that of FIG. 4 (not in accordance with the present invention) is essentially silicon free. A more detailed description of the Figures is given in the Examples.

THE INVENTION

Generally, the present invention concerns nickel-magnesium alloys that are particularly useful as additives in processes for the continuous treatment of cast iron melts to produce ductile cast iron. In such processes the alloys are contacted with a stream of molten iron as it flows through a treatment zone. As indicated previously, the treatment zone may be a separate vessel or may be a separate area in a given apparatus. In a preferred embodiment of the invention the reaction of the alloy additive with the molten iron is completed in the treatment zone. Reaction occurs at a temperature in the range of about 2500° to about 2700° F.

In accordance with the present invention, improvement in continuous treatment can be achieved by providing as the addition alloy, a nickel-magnesium-iron-silicon alloy consisting essentially of, by weight, from about 3% to about 6% by magnesium, from above 20% to about 40% iron, from about 2% to about 12% silicon, and the balance apart from impurities and incidental elements essentially nickel, the nickel content being at least about 50%.

Preferably, the alloys contain about 4% to about 5% magnesium, about 25% to about 35% iron, about 4% to about 6% silicon, and the balance at least about 50% nickel.

Depending on such considerations as cost, the charge materials for the preparation of the alloy, and ultimate use, various elements may be present in alloys of this invention.

For example, small amounts of one or more of the elements calcium, cerium and other rare earth metals may be deliberately added to provide specific benefits. These elements may be added in various combinations in amounts of about 1% or less. The utility of these elements in conjunction with magnesium treatment alloys is well known.

Incidental elements, e.g. manganese, copper, or cobalt in amounts of up to about 10% total, aluminum, or barium in amounts of up to about 1% each, and small traces of sulfur (less than 0.1%) and phosphorus (less than 0.1%) may be present. These elements are for the most part undesirable in cast iron, but may be present in the additive for convenience of production of the alloy, e.g. they be carried along as impurities in the charge materials in preparing the alloys.

With respect to the magnesium content it has been found that in the range of about 4% to about 6% the alloys will have suitably low reactivity on addition to the melt. The lower limit of magnesium, i.e. about 4%, is defined by the treatment cost to obtain the required magnesium addition, while the upper limit, i.e. about 6%, is defined by alloy reactivity.

The silicon content is particularly critical at least about 2% being required for good crushability while over 12% tends to increase the reactivity of the alloy. More important, alloys with higher levels of silicon tend to be too brittle and form excessive fines during crushing. Advantageously, silicon is present in an amount of about 3 to about 7%. Silicon present in an amount of above 4% to about 6% is particularly preferable for the combination of low reactivity and ease of production.

The iron content of the alloy should be at least above 20% for economic reasons. However, in general, the iron and nickel contents are related. The iron may be regarded as a substitute for the nickel content of the alloy. The minimum nickel content is about 50%. When the nickel content falls below this level, there is an undesirable increase in product reactivity and difficulty in production of the alloy.

Carbon need not be present. However, it may be present in amounts up to about 2%, and its presence tends to moderate the reactivity of the alloy and to facilitate the solubility of magnesium in the melt. The maximum amount of carbon that can be present in the alloy depends on solubility considerations in the melt and it progressively decreases from about 2% carbon at about 2% silicon to less than about 0.5% carbon at about 12% silicon. At the level of about 5% silicon and higher, the level of carbon is generally no higher than 1%. Satisfactory alloys contain less than 1% or 0.5% carbon and may be substantially carbon free.

Alloys exemplary of the invention are given in TABLE I.

TABLE I

| | COMPOSITION - WEIGHT % | | | | | |
|---|---|---|---|---|---|---|
| Alloy | Mg | Fe | Si | C | Ni | Others |
| 1 | 5 | 25 | 10 | 0.1 | Bal. | |
| 2 | 5 | 30 | 5 | 1.0 | Bal. | |
| 3 | 5 | 30 | 5 | 0.1 | Bal. | |
| 4 | 4 | 35 | 10 | 0.1 | Bal. | |
| 5 | 5 | 21 | 7 | <0.1 | Bal. | |
| 6 | 4 | 25 | 10 | 0.1 | Bal. | 10 Cu |
| 7 | 4 | 25 | 10 | 0.1 | Bal. | 10 Co |
| 8 | 4 | 25 | 4 | 1.0 | Bal. | |
| 9 | 6 | 35 | 6 | <0.1 | Bal. | |
| 10 | 4 | 30 | 5 | 0.9 | Bal. | |

Standard techniques may be used to prepare alloys of this invention. For example, using a high frequency induction furnace the iron and nickel (and carbon, if any) are melted down, ferrosilicon is added then magnesium is added. Raw materials may include electrolytic nickel, nickel scrap, nickel pellet, steel scrap, ferrosilicon, ferronickel, and so on. Preferably, the molten alloy is chill cast as thin slabs in metal molds. The cooling rate should be fairly rapid and, preferably, unidirectional. Such conditions are provided by casting a relatively thin, e.g. ½ inch to 1 inch, slab on a metal chill surface, e.g. cast iron, copper, steel, and the like. Alternatively, and preferably, a metal mold may be made using two chill surfaces spaced ½ inch to 1 inch apart. A rapid cooling rate is roughly of the order of 10° F/second.

To give those skilled in the art a better appreciation and understanding of the advantages of the invention, the following examples are given.

EXAMPLE 1

Three alloys having a composition in accordance with the present invention are prepared as 11 kg. induction heats as follows: Nickel and iron are melted - with carbon, when included, added to the initial charger. Ferrosilicon is added, the melt is heated to 2650° F (1450° C), then cooled to 2500° F (1370° C), and magnesium is added in controlled portions. The compositions of the alloys are given in TABLE II.

TABLE II

| Alloy | C | Mg | Fe* | Si | Ni |
|---|---|---|---|---|---|
| 11 | N.A. | 4.71 | 25.6 | 9.70 | 60.0 |
| 12 | 1.40 | 4.93 | 29.0 | 5.02 | 59.7 |
| 13 | N.A. | 4.53 | 30.2 | 4.97 | 60.3 |

*by difference
N.A. = none added, not analyzed.

The heats are cast as ⅝-inch thick slabs on a heavy cast iron block and as one-pound truncated cone pigs in a cast iron mold. They are crushed in a jaw crusher and the relative ease of crushing noted. The easiest alloy to crush is Alloy 12, followed by Alloy 13 and then by Alloy 11. The slab castings are far easier to crush than the pigs. The one-pound truncated pigs tend to jam the crusher. Contrastingly, the ⅝-inch slabs form particles about ¼ to ⅛ inch in size and substantially no fines. (Less than 3% is minus 50 mesh.)

EXAMPLE 2

An 11 kg. heat of an alloy composed of 1.5% carbon, 4.25% magnesium, 34.25% iron, and 60% nickel is induction melted and cast as a ⅝-inch thick slab and as one-pound truncated cone pigs in a similar manner to the alloys of Example 1. This alloy is similar to Alloy No. 12, except that no silicon is added to the melt. The alloy is designated as Alloy No. 14.

Both product forms are extremely difficult to crush; they tend to jam the crusher.

A heat similar in composition and preparation to Alloy No. 14 is subjected to a water fragmenting process wherein a molten stream of the alloy is poured into the horizontal region of a free-falling, high volume stream of water. Although the fragmenting and water shotting equipment provides an extremely rapid cooling rate, the product produced is neither brittle nor easily converted to useful size particles, but is a loose mat of thin, highly oxidized particles unsuitable for use as an additive for treatment of molten iron.

EXAMPLE 3

Metallographic examination and electron probe microanalysis of Alloys 11, 12 and 14 showed the presence of the phases and phase compositions tabulated in TABLE III.

TABLE III

| Alloy No. | Description of Phase | Composition of Phase* Wt. % Ni | Fe | Mg | Si | C |
|---|---|---|---|---|---|---|
| Alloy 11 | White Continuous | 69.7 | 1.7 | 11.6 | 16.9 | N.A. |
| | Gray | | | | | |
| | Light areas | 46.8 | 45.8 | 0.0 | 7.3 | N.A. |
| | Dark areas | 42.5 | 38.7 | 0.0 | 8.8 | N.A. |
| Alloy 12 | White Dendrites | 55.6 | 41.3 | 0.0 | 3.0 | 0.0 |
| | Black | 64.9 | 15.5 | 13.3 | 6.9 | 3.7 |
| | Light Gray | 69.0 | 11.0 | 11.2 | 9.9 | 0.0 |
| | Dark Gray | 68.0 | 14.9 | 12.0 | 0.0 | 0.0 |
| Alloy 14 | White | 57.1 | 43.4 | 0.0 | N.A. | 0.2 |
| | Dark Gray | 73.9 | 9.8 | 19.0 | N.A. | 0.2 |
| | Black | 69.9 | 13.2 | 11.4 | N.A. | 2.6 |

*Values are not normalized to 100%
NA = Not Analyzed

Micrographs of Alloys 11, 12, 13 and 14 — shown in FIGS. 1, 2, 3 and 4, respectively — are at 500x magnification. The microstructures of slab castings were prepared using a two stage etching process. The polished surface was first etched with Merica's Reagent (equal parts of nitric & acetic acids). The samples were then rinsed in alcohol and etched with a dilute solution of Merica's Reagent in methanol (10:1 dilution).

Figure 4:
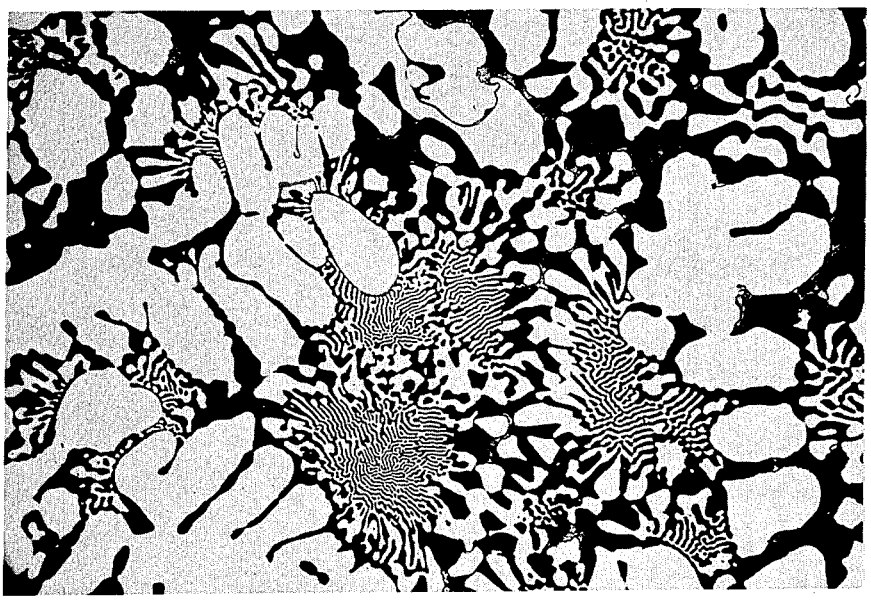

Referring to FIGS. 2 and 4 and the data in TABLE III, it will be noted that four phases can be distinguished in Alloy 12 in addition to spheroidal graphite. Of these phases, two are analogous to those found in Alloy 14. The primary dendrites (white) are essentially nickel-iron, as in Alloy 14, but with a small amount of silicon. The black phase is the high carbon phase, similar to the black carbon-containing phase of Alloy 14. In Alloy 12, the phase also contains a substantial amount of silicon. From the composition of this phase, it is judged to be brittle. Because of its morphology it may contribute in some measure to the crushability of the alloy. A more significant contributor to the crushability of Alloy 12, however, is believed to be the light gray phase. There are two gray phases in Alloy 12. The darker of the two gray phases is predominantly nickel and contains magnesium and iron, but no carbon or silicon. The light gray phase is similar, but contains nearly 10 wt. % silicon. The morphology of this high silicon phase is nearly continuous, both in areas where it surrounds the primary nickel-iron (white) dendrites, and in those where it solidifies as a ternary eutectic with the high carbon (black) phase and the nickel-iron phase. It is the continuity of this light gray phase which is believed to be most important with respect to crushability of the alloy since it has a composition which can be expected to be brittle.

Alloy 13 is similar in composition to Alloy 12, except that no carbon is added. Microprobe analysis was not performed on Alloy 13, however, the microstructure (as shown in FIG. 3) appears to be similar to that of Alloy 12 but without the high carbon (black) phase and with more of the dark gray phase. Assuming that the compositions of the phases in Alloys 13 are similar to those of the corresponding phases in Alloy 12, it is believed that the lower crushability of Alloy 13 is probably due to the smaller amount of the light gray phase.

The microstructure of Alloy 11 (FIG. 1), containing about 10% silicon, but no carbon, shows two major phases. The continuous white phase contains nearly 17% silicon and over 11% magnesium. A phase of this composition can be expected to be brittle. In this alloy, however, the brittleness of the continuous phase is mitigated somewhat by the very fine rodlike morphology of the second phase. This phase corresponds to the ductile nickel-iron phase of Alloy 14, but it contains some silicon. The change in etching response of the gray phase from very light to almost black, even within the same particle, is caused by a small variation in silicon and iron content. The dark etching regions contain about 9% silicon and 39% iron, while the light gray regions contain about 7.5% silicon and 46% iron.

Of the alloys examined, it is believed it is the continuity of a high-silicon containing phase, e.g. containing 9.9% silicon in Alloy 12 and 16.9% silicon in Alloy 11, that contributed significantly to the crushability of the alloy.

EXAMPLE 4

This example is given to illustrate the addition of an additive in a continuous treatment process for producing ductile cast iron.

Iron is melted in an induction furnace or cupola using procedures well established in the ductile iron industry. Conventional raw materials are used, i.e., casting returns, purchased scrap and pig iron. The iron is tapped into a transfer ladle at about 2800° F (~ 1540° C) with a typical composition of 3.5C-2.0Si-0.25Mn-0.02S. The iron is subsequently bottom poured into the treatment apparatus, care being exercised to maintain a uniform rate of metal flow. Simultaneously, the treatment alloy is metered into the stream as it swirls into the vortex. The additive is the crushed Ni-Fe-Si-Mg alloy of this invention having a composition of Alloy No. 12 and consisting of particles no larger than a pea and no finer than a grain of rice. The additive is fed by gravity with a slight positive pressure of air to prevent clogging. The quantity of additive is related to the flow rate of iron in such a way that approximately 0.05% Mg (20 lb. of 5% Mg alloy per ton of iron) is added. The additive is carried under the surface of the melt by the action of the vortex. Being a "quiet" additive, it melts and dissolves into the iron with virtually no smoke or flare. In contrast, a high reactivity alloy causes the iron to boil violently, the resulting turbulence in turn preventing free flow of the iron through the outlet orifice. Subsequently, the iron exits through a channel into a ladle capable of holding about 1000-pounds of iron. At this point the iron is inoculated with 0.5% Si in the form of ferrosilicon or other silicon-base alloy and then poured into industrial castings.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. In a continuous treatment process for producing ductile cast iron in which a nickel-magnesium addition agent is added to a molten stream of cast iron passing through a treatment zone, the improvement comprising utilizing as the addition agent an alloy having a composition consisting generally of, by weight, from about 3% to about 6% magnesium, from above 20% to about 40% iron, from about 2% to about 12% silicon, and the balance apart from incidental elements and impurities, essentially nickel, said nickel content of the alloy being at least about 50% and said alloy being characterized in that it is crushable without the formation of excessive fines.

2. A process according to claim 1, wherein the silicon content of addition alloy is about 3% to about 7%.

3. A process according to claim 1, wherein the addition alloy contains from about 4% to about 6% magnesium, about 4% to about 6% silicon and about 25% to about 35% iron.

4. A process according to claim 1, wherein the addition alloy contains up to about 2% carbon, the carbon content being related inversely to the silicon content.

5. A process according to claim 3, wherein the carbon content of the addition alloy is less than about 1%.

6. A process according to claim 1 wherein the alloy contains up to about 10% manganese, up to about 10% copper, up to about 10% cobalt, the total amount of manganese, copper and cobalt being up to about 10%, up to about 1% aluminum, up to about 1% barium, less than about 0.1% sulfur, and less than about 0.1% phosphorus.

7. A method of preparing a crushable alloy which is especially useful as an addition agent in a process for the continuous treatment of cast iron to produce ductile cast iron comprising, preparing in the form of a melt, an alloy having the composition consisting essentially of, by weight, from about 3% to about 6% magnesium, from above about 20% to about 40% iron, from about 2% to about 12% silicon, up to about 2% carbon, and the balance, apart from incidental elements and impurities, essentially nickel, said nickel content of the alloy being at least about 50% and subjecting the melt to a rapid and unidirectional cooling rate, thereby producing an alloy characterized in that it is crushable without the formation of excessive fines.

8. A method according to claim 7, wherein the alloy is prepared as a casting in a slab of about ½ to about 1 inch in thickness on a metal chill surface.

9. A method according to claim 8 wherein the slabs formed are crushable to particles having a size substantially of about ¼ to about ⅛ inch.

* * * * *